US010813399B2

(12) United States Patent
Murray

(10) Patent No.: US 10,813,399 B2
(45) Date of Patent: Oct. 27, 2020

(54) NECKTIE RETAINER

(71) Applicant: Marion A. Murray, Palmdale, CA (US)

(72) Inventor: Marion A. Murray, Palmdale, CA (US)

( * ) Notice: Subject to any disclaimer, the term of this patent is extended or adjusted under 35 U.S.C. 154(b) by 110 days.

(21) Appl. No.: 15/970,172

(22) Filed: May 3, 2018

(65) Prior Publication Data

US 2019/0335828 A1 Nov. 7, 2019

(51) Int. Cl.
*A41D 25/10* (2006.01)

(52) U.S. Cl.
CPC ..... *A41D 25/10* (2013.01)

(58) Field of Classification Search
CPC ..... A41D 25/025; A41D 25/10; A41D 25/02; A41D 25/022; A41D 25/16
USPC ..... 2/144, 148–150, 152.1, 153; D2/609
See application file for complete search history.

(56) References Cited

U.S. PATENT DOCUMENTS 1,086,493 A * 2/1914 Wechsler ..... A41D 25/025 2/153
5,010,593 A * 4/1991 Stevens, Jr. ..... A41D 25/022 2/148
5,774,893 A * 7/1998 Torres ..... A41D 25/025 2/148
6,305,025 B1 10/2001 Pilon
6,658,667 B1 12/2003 Galante
7,162,747 B2 1/2007 Sampy
8,931,116 B2 1/2015 Lucero
2004/0187187 A1* 9/2004 Morrison-Gale .... A41D 25/022 2/144
2014/0317831 A1* 10/2014 Woody ..... A41D 25/025 2/152.1

FOREIGN PATENT DOCUMENTS

WO WO2005/115184 * 12/2005 ..... A47D 25/10

* cited by examiner

*Primary Examiner* — Katherine M Moran
(74) *Attorney, Agent, or Firm* — Brooks Kushman P.C.

(57) ABSTRACT

A retainer, and method for preparing a retainer, for a necktie to receive the ends of the necktie looped over, or to be looped over, the neck of a user or, comprising a piece of flexible fabric having a center section and end sections, the material being fitted at reverse opposite end sections with connecting members and shaped to form a frustum-shaped retainer when one end section is folded over the other end section and the connecting members are secured to each other whereby the retainer can then slide over the received necktie ends to move the retainer upwardly to the neck of the user.

10 Claims, 5 Drawing Sheets

NECKTIE RETAINER

FIELD OF THE INVENTION

The invention relates to a retainer for a necktie allowing a conventional necktie to be worn without a knot.

BACKGROUND OF THE INVENTION

Conventional neckties are constructed from various materials, also called fabrics herein, such as woven or knitted cloth made from wool, silk, cotton, polyester or other synthetic material, or soft flexible leather strips. Modern neckties have a front end and a rear end, the rear end usually being thinner but generally no wider than the front end and are intended to be worn around the neck by forming a knot in which the front end passes through an overlap of the material usually approximately between the midway of the ends of the necktie. Neckties commonly use a single wide symmetrical triangular knot, referred to as a Windsor knot. Tying a proper knot requires a fair amount of practice to have the rear end not extend beyond the front end, yet not be so short that the front end extends too far down. Youngsters often find it difficult and tedious, lacking the needed manual dexterity or muscle memory to properly tie a conventional necktie. Those with certain physical disabilities can find it frustratingly difficult without help. Moreover, when a necktie is tied and untied, the area where the knot is formed can become wrinkled and distorted.

Various solutions to the foregoing problems have been proposed, from clip-on neckties to ties with a pre-tied knot. Pilon U.S. Pat. No. 6,305,025 describes a permanently knotted tie having an adjustable neck band and requires fixing releasable fasteners such as Velcro® to the tie or using press studs on the necktie, unconventional ties that are specially made and fixedly secured to a tubular section. Galante U.S. Pat. No. 6,658,667 describes a pre-knotted adjustable necktie in which one end of the neck embracing loop is attached to the knot with the other side of the loop extending through a guide loop attached to the knot. Galante also requires unconventional, specially made ties. Lucero U.S. Pat. No. 8,931,116 describes a pre-knotted adjustable necktie having a pre-knot form molded from plastic and connected by clips to a top, rigid structure through which necktie ends are threaded, structure that is costly to make and with its molded plastic nature presents an artificial look. Sampy U.S. Pat. No. 7,162,747 describes a shell fashioned from metal or plastic and configured to slip over a knot in a necktie to protect the knot but does nothing to facilitate the tying of the necktie around the user's neck.

BRIEF SUMMARY OF THE INVENTION

The present invention overcomes the foregoing drawbacks by avoiding the tying of a knot in the necktie. Rather, a retainer secures a necktie looped around a user's neck, the necktie being any conventional, off-the-shelf necktie without any modification needed to be made to the necktie. The retainer is made of a flexible piece of fabric, which can be woven or knitted cloth made from wool, silk, cotton, polyester or other synthetic material, or can be soft flexible leather. The fabric piece can be of the same material of which the necktie is formed and preferably contains no rigid material in the retainer itself, exclusive of components of a fastening device or fancy pins or other decorative items.

The fabric piece can be formed from a single piece of flexible material which when laid flat preferably has adjacent mirror image members on opposite sides of a longitudinal axis. The fabric piece can be doubled over along the longitudinal axis and fixed, such as by stitches to form the necktie retainer in the shape of an irregular polygon. The retainer when so doubled over and stitched has a generally rectangular center segment and right and left irregularly shaped end sections. The retainer can be fitted at reverse opposite ends with connecting members that when folded connect to secure the ends. The connecting members can be components of a fastening device, which can be a snap having prong and receptor components, or a clasp or catch. Preferably the fastening device is hook and loop material, such as the hook and loop components of Velcro®.

The retainer is shaped so that when one end section is folded over the other end section with opposing connecting members facing each other, a frustum-shaped retainer is obtained, the wider end facing up. In use, the retainer member can be folded around the upper part of the ends of a necktie or the ends can be inserted into the folded retainer, for example with thin neckties. In either case, the resultant necktie loop can have been on the neck of the user when formed or the loop is first formed and then the user's head can be inserted into the loop. The retainer is then pushed upwardly to tighten the necktie.

The retainer can be decorated as desired or a pin can be affixed to the retainer to provide a fashion statement.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
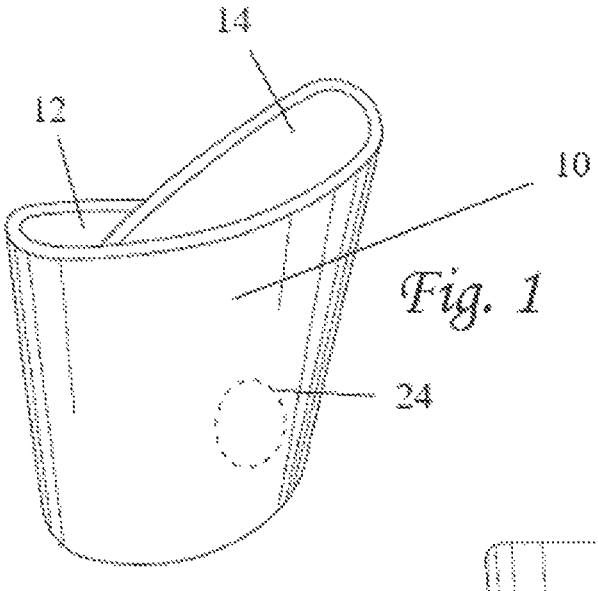
FIG. 1 shows a retainer in accordance with this invention with one end section of the retainer folded over the other end section with opposing connecting members facing each other to form a frustum.
Figure 2:
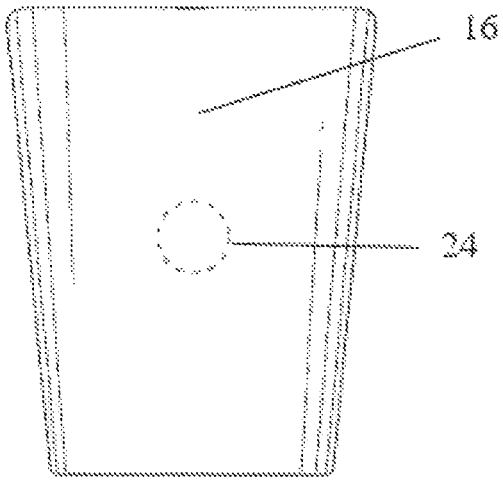
FIG. 2 shows the front view of the folded retainer.
Figure 3:
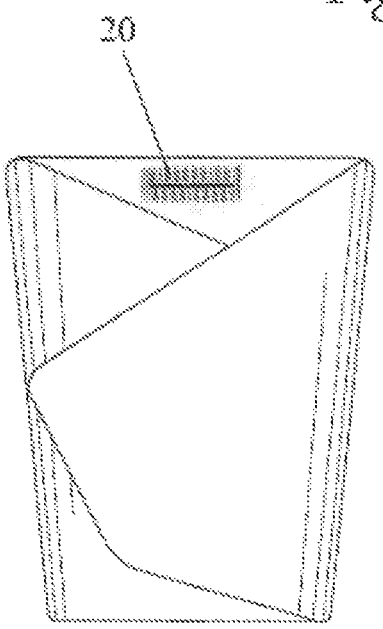
FIG. 3 shows the rear view of the folded retainer.

Referring to FIGS. 1-3, a retainer 10 in accordance with this invention is shaped so that when one end section 12 is folded over the other end section 14 with opposing connecting members facing each other, a frustum-shaped retainer 10 is obtained, the wider end facing up.

Figure 4:
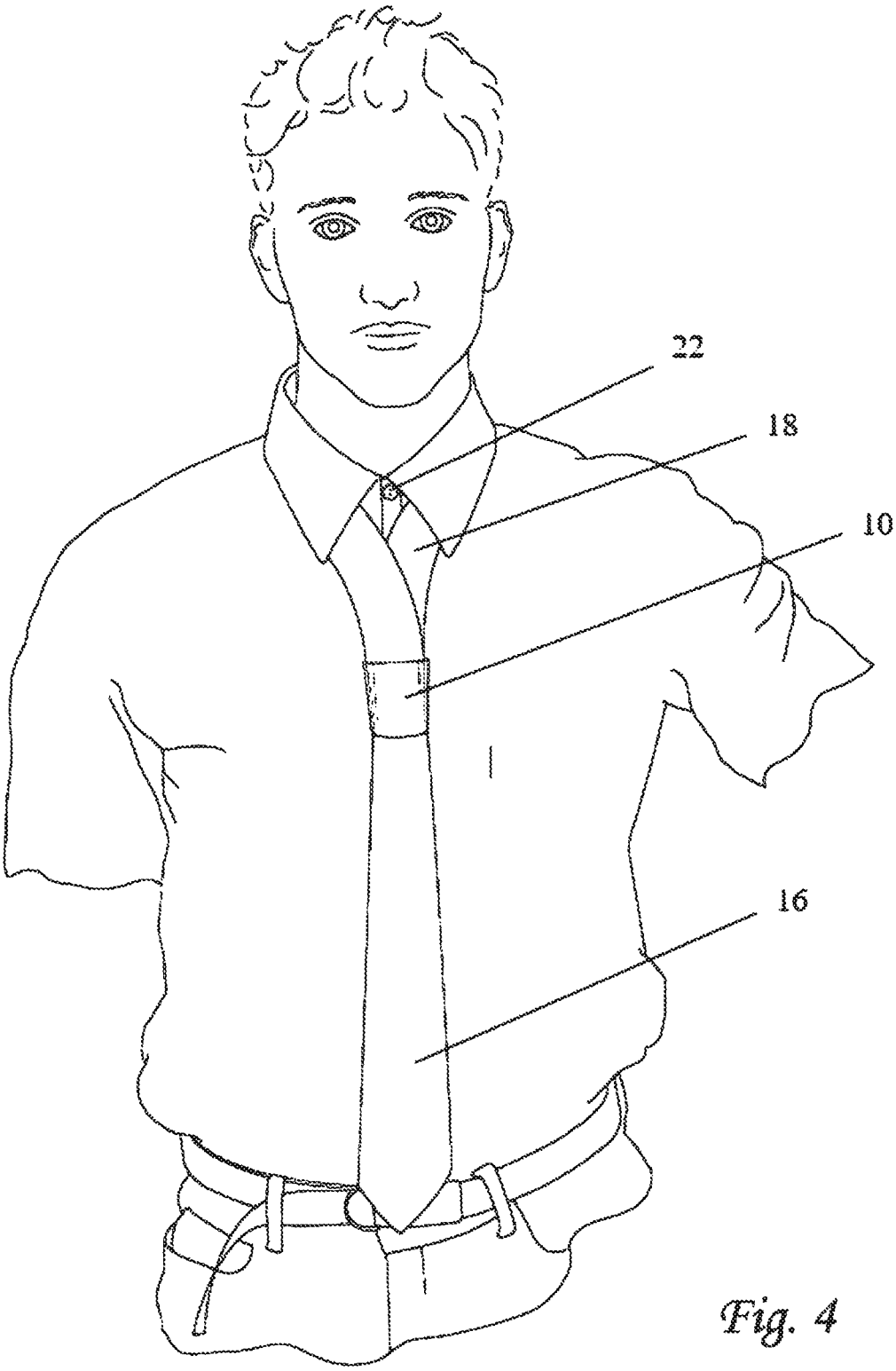
FIG. 4 is a depiction of a retainer in accordance with this invention shown wrapped around a necktie prior to being pushed up.
Figure 5:
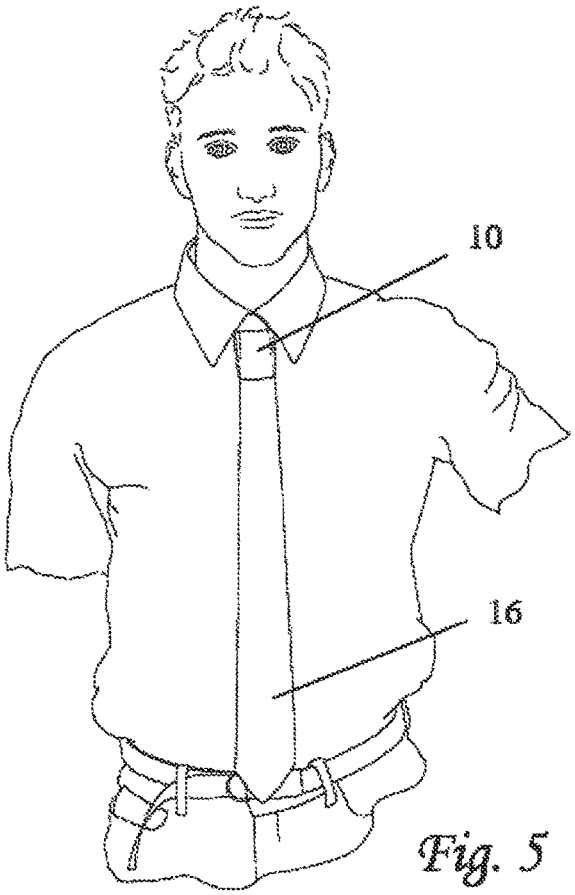
FIG. 5 is a depiction of the retainer of FIG. 1 fully pushed up against the neck of a user to lie partially under the collar of the user's shirt.

Any conventional, off-the-shelf necktie can be used with the retainer without any modification needed and has a front end 16 and rear end 18. The user has on a shirt with a top button 20 closing the shirt around the user's neck. Referring to FIG. 4, the necktie can be placed around the neck of the user and the retainer 10 then either wrapped around the ends 16,18 of a necktie or the ends 16, 18 can be inserted into the folded retainer 10. Alternatively, first the necktie can be assembled with the retainer to form a loop and then the user's head can be inserted into the loop. Referring additionally to FIG. 5, the retainer is pushed up against the neck of the user to lie partially under the collar of the user's shirt. As shown in FIG. 3, the retainer can be formed with a rear button hole 20 to connect the retainer to the top button 22 of the user's shirt to prevent the retainer from sliding down.

The retainer is made of a flexible piece of fabric, which can be woven or knitted cloth made from wool, silk, cotton, polyester or other synthetic material, or can be soft flexible leather. The fabric piece can be of the same material of which the necktie is formed and preferably contains no rigid material in the retainer itself (exclusive of components of a fastening device or fancy pins or other decorative items).

Figure 6:
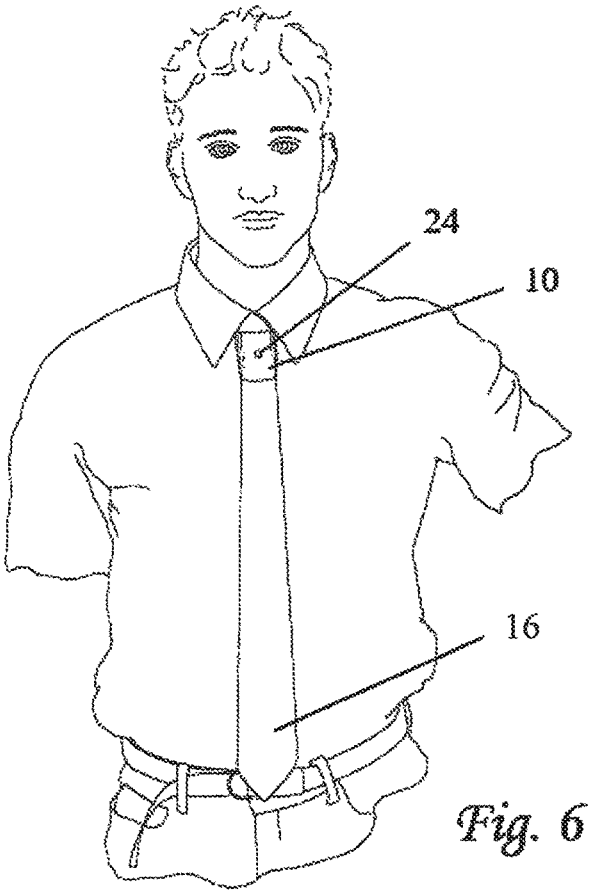
FIG. 6 is the same depiction as in FIG. 5 but showing a decorative pin affixed to the retainer to provide a fashion statement.

Referring to FIG. 6, a decorative pin 24 can be affixed to the retainer to provide a fashion statement, as also shown in shadow in FIGS. 1, 2, 9, and 10.

Figure 7:
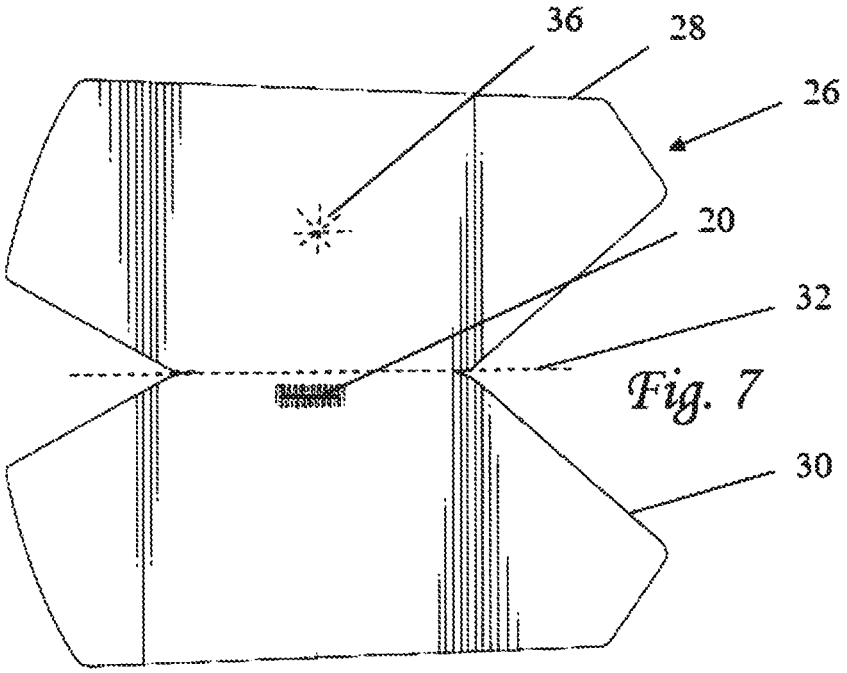
FIG. 7 shows one side of a piece of fabric at a first stage of manufacturing prior to doubling over to form the retainer.
Figure 8:
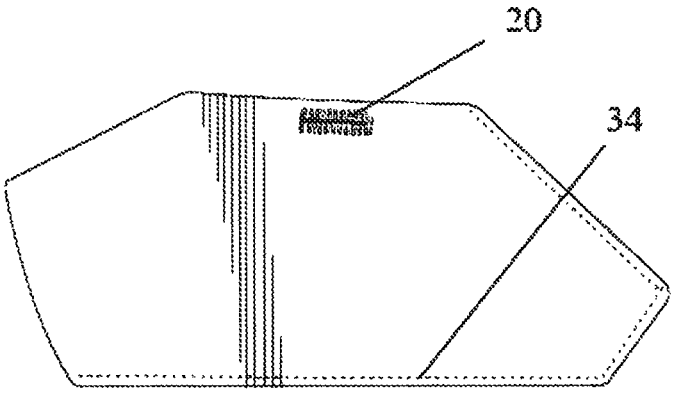
FIG. 8 shows the body of the retainer doubled over and fixed with stitching along one end and along its bottom but not along the opposite end to allow the retainer body to be turned inside-out.
Figure 9:
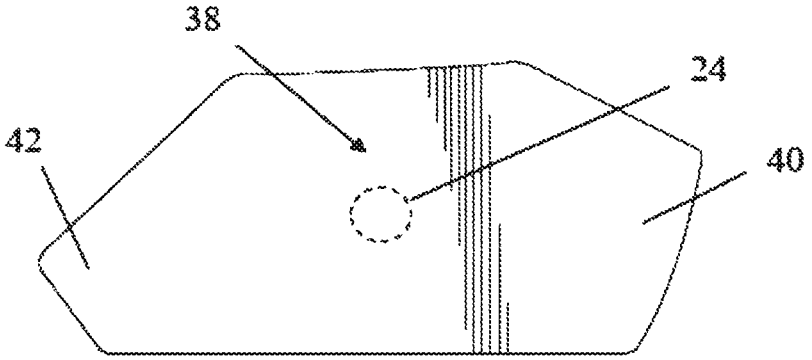
FIG. 9 shows the retainer body of FIG. 8 turned inside-out.

Referring to FIGS. 7-9, the retainer can be formed from a single piece of fabric 26 which when laid flat preferably has adjacent mirror image members 28 and 30 on opposite sides of a longitudinal axis 32. Referring to FIGS. 8 and 9, showing respectively front and rear opposite sides of the retainer 10, the fabric 26 of the retainer can be doubled over along its longitudinal axis 32 to form the body of the retainer as an irregular polygon. Stitching 34 along one end and along the bottom of the retainer body, but not along the opposite end enables the retainer body to be turned inside-out as shown in FIG. 9.

Referring again to FIG. 7, stitching 36 is shown in shadow at the place where a decorative pin 24 is sewn through the material of the retainer body.

Figure 10:
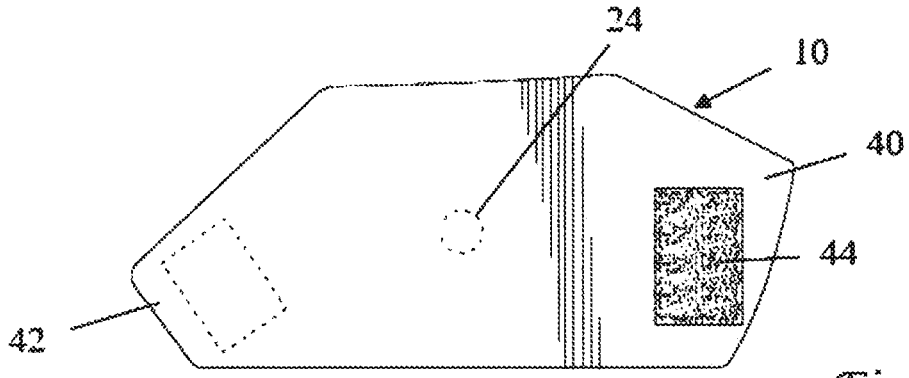
FIG. 10 shows the retainer of FIG. 9 with one component of a hook and loop material fixed by stitching on one end section of the retainer.
Figure 11:
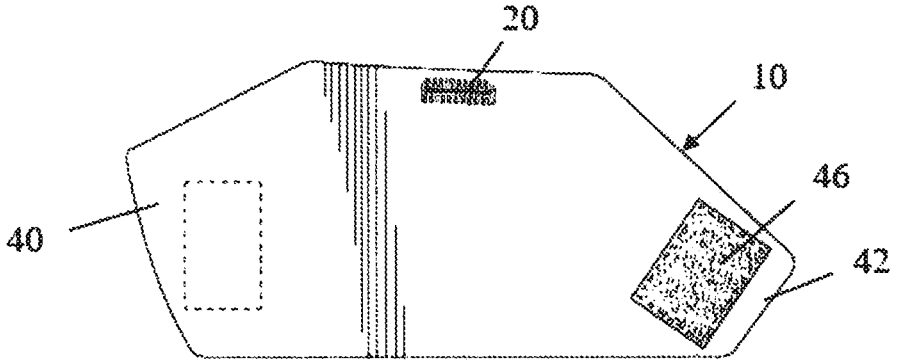
FIG. 11 shows the opposite side of the retainer shown in FIG. 10 with the other component of a hook and loop material fixed by stitching on the opposite end section of the retainer and with a button hole along the top edge.
Figure 12:
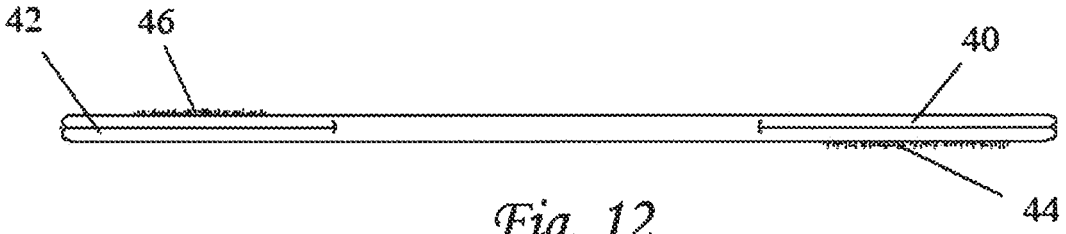
FIG. 12 shows a top plan view of the retainer of FIG. 9.
Figure 13:
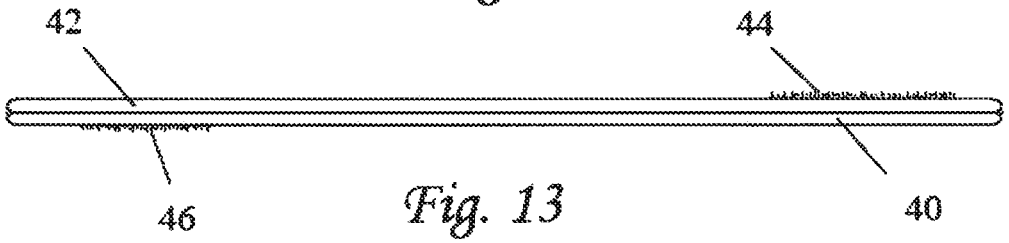
FIG. 13 shows a bottom plan view of the retainer of FIG. 9.

The inside-out body of the retainer 10 has a generally rectangular center segment 38 and end sections 40 and 42 that are asymmetrical in their relative positions about a vertical axis and about a horizontal axis. Referring to FIGS. 10 and 11, the retainer can be fitted at its reverse opposite wing ends with connecting members, respectively 44 and 46, of a fastening device that connect to secure the ends. Preferably the fastening device is hook and loop material, such as the hook and loop components of Velcro. In other words, one part of the connecting member 44 such as the loop component of Velcro® is affixed (e.g., by stitching) to one side of the retainer at one wing 40 while the other part of the connecting member 46 such as the hook component of Velcro® is affixed to the rear side of the retainer at the other wing 42. Alternatively, the connecting members can constitute a snap having prong and receptor components, or a clasp or catch mechanism. As shown in FIGS. 3, 7, 8, and 10, the rear of the retainer 10 can have a button hole 20 cut and stitched centrally adjacent the upper edge of the retainer 10.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

The invention claimed is:

1. A retainer for a necktie to receive the ends of the necktie therethrough, comprising a flexible fabric retainer body with a fold at an upper edge, the fold dividing the retainer into adjacent mirror image members, one member forming a front side and the other member forming a rear side of the retainer body, the front and rear sides secured together at their respective perimeters, the retainer body having a center section and end sections that are asymmetrical in their relative positions about a vertical axis and about a horizontal axis of the retainer body, the retainer body having a connecting member of a fastening device on a front side end section and having a complementary connecting member of the fastening device on a rear side end section, and the connecting members configured to be secured together to form a frustum-shaped retainer when one end section is folded over the other end section, whereby the retainer is configured to slide over necktie ends and move upwardly to a neck of a user.

2. The retainer of claim 1 containing no rigid material in the retainer itself, exclusive of connecting members or decorative items.

3. The retainer of claim 1 in which said connecting members are hook and loop materials.

4. The retainer of claim 1 having the shape of an irregular polygon.

5. The retainer of claim 1 having a decorative pin affixed to the center section of the retainer.

6. A retainer for a necktie to receive the ends of the necktie therethrough, comprising a flexible fabric retainer body with a fold at an upper edge, the fold dividing the retainer into adjacent mirror image members, one member forming a front side and the other member forming a rear side of the retainer body, the front and rear sides secured together at their respective perimeters, the retainer body having the shape of an irregular polygon and containing no rigid material exclusive of connecting members or decorative items, the retainer body having a center section and end sections extending from the center section, the end sections are asymmetrical in their relative positions about a vertical axis and about a horizontal axis of the retainer body, the retainer body having a hook material secured to one end section front or rear side, and a loop material secured to the other side end section, the hook and loop material configured to be secured together to form a frustum-shaped retainer when one end section is folded over the other end section, whereby the retainer is configured to slide over necktie ends and move upwardly to a neck of a user.

7. The retainer of claim 6 having a decorative pin affixed to the center section of the retainer.

8. A method for preparing a retainer for a necktie of claim 1, comprising the steps of: preparing a single piece of fabric which when laid flat has adjacent mirror image members on opposite sides of a longitudinal axis, and folding the fabric along the longitudinal axis to form a retainer body shaped as an irregular polygon having a front side, rear side, two end sections, and an upper edge, stitching along only one end and along a bottom of the retainer body, and not along an opposite end, turning the retainer body inside-out, attaching a connecting member of a fastening device to a front side end section, and attaching a complementary connecting member of the fastening device to a rear side end section, and securing the ends of the retainer together via the respective connecting members.

9. The method of claim 8 wherein the retainer body has a button hole therein provided centrally adjacent its upper edge.

10. The method of claim 8 wherein the fastening device is hook and loop material and wherein the loop material is secured to said one end section and the hook material is secured to the other said end section.

* * * * *